United States Patent [19]

Škrabák et al.

[11] 4,048,008

[45] Sept. 13, 1977

[54] METHOD OF AND APPARATUS FOR FORMING SHEETS OF FIBROUS MATERIAL BETWEEN CONVERGING SIEVES

[75] Inventors: Michal Škrabák; Ernest Vavrík; Stanislav Kolařík; Miloš Mazák, all of Bratislava, Czechoslovakia

[73] Assignee: Slovenska Vysoka Skola Technicka, Bratislava, Czechoslovakia

[21] Appl. No.: 658,079

[22] Filed: Feb. 13, 1976

[30] Foreign Application Priority Data

Feb. 13, 1975 Czechoslovakia ..... 902/75

[51] Int. Cl.[2] ..... D21F 1/00; D21F 11/00; D21H 1/06

[52] U.S. Cl. ..... 162/104; 162/132; 162/203; 162/213; 162/268; 162/292; 162/299; 162/301; 162/303; 162/342

[58] Field of Search ..... 162/104, 124, 132, 203, 162/208, 213, 216, 217, 268, 292, 297, 298, 299, 301, 303, 322, 342, 351

[56] References Cited

U.S. PATENT DOCUMENTS

| | | | |
|---|---|---|---|
| 3,316,142 | 4/1967 | Gahmberg | 162/213 X |
| 3,654,074 | 4/1972 | Jacquelin | 162/292 X |
| 3,717,546 | 2/1973 | Jacquelin | 162/292 X |
| 3,810,817 | 5/1974 | Arledter | 162/203 X |
| 3,867,252 | 2/1975 | Skrabak et al. | 162/104 X |

FOREIGN PATENT DOCUMENTS

| | | | |
|---|---|---|---|
| 864,654 | 1/1953 | Germany | 162/292 |

*Primary Examiner*—S. Leon Bashore
*Assistant Examiner*—Richard V. Fisher

[57] ABSTRACT

A technique for forming single or multi-layer sheets of fibrous material having a controllable fiber distribution is described. A pair of spraying rollers each having a system of circumferentially spaced radial vanes on its surface are supported within the upper portion of a working zone defined between a pair of continually advancing, downwardly converging sieves that are disposed symmetrical to a longitudinal axis. The rollers are rotated in respectively opposite directions to intercept at least one fibrous suspension downwardly directed into the working zone, and to thereafter propel the intercepted liquid outwardly and downwardly toward the sides of the working zone in symmetrical fashion. The fibrous layers thus built up on the advancing sieves converge into the final sheet in the lower portion of the working zone. Separate facilities are associated with the upper and lower portions of the working zone for drawing liquid from the formed layers outwardly through the sieves.

23 Claims, 4 Drawing Figures

METHOD OF AND APPARATUS FOR FORMING SHEETS OF FIBROUS MATERIAL BETWEEN CONVERGING SIEVES

BACKGROUND OF THE INVENTION

The invention relates to techniques for forming single or multi-layer sheets of fibrous material such as recycled paper, and more particularly to methods and apparatus of this type wherein fibrous suspensions are introduced into a forming or working zone estabished between two advancing converging sieves.

Existing techniques of this type for the manufacture of sheets of fibrous materials have the disadvantage that the cross-sectional distribution of the suspended particles in the finished sheet is difficult to control. In particular, the finer particles in the portion of the suspension in contact with the walls of the sieve defining the working zone are rapidly filtered out through the associated sieves, so that the exterior portion of the resulting sheet invariably has a much smaller concentration of fine particles than the more interior regions of the sheet. The resultant high concentration of relatively large particles and dirt mar the appearance of the external surface of the sheet, and also degrades its physical strength. Such degradation in strength is further aggravated by the tendency of the fibers in the suspension to flocculate.

Such inhomogeneity of the particle distribution of sheets resulting from such prior process is particularly significant during the formation of multi-layer sheets, since the uncontrollability of the particle distribution tends to prevent the efficient interengagement of the particles forming the surface of one layer with the particles associated with the interface on the other layer. As a result, the adjacent layers are subject to separation by peeling.

SUMMARY OF THE INVENTION

These disadvantages are overcome by the method and apparatus for forming a sheet of fibrous material in accordance with the invention. Illustratively, at least one fibrous suspension to be formed into a layer on the resulting sheet is introduced from above into the upper part of the wedge-shaped working zone defined between the advancing, downwardly converging sieves. The introduced liquid is intercepted by means of radial vanes extending from the circumferential surfaces of a pair of transversely spaced, oppositely rotating spraying rollers which are supported in the upper portion of the working zone.

The spraying rollers, whose transverse spacing is advantageously adjustable, are effective to propel the intercepted fluid outwardly and downwardly toward the converging walls and the bottom of the working zone at a velocity which is related to the speed of rotation of the rollers; such rotational speed is illustratively also made adjustable. Such symmetrical propulsion of the fluid is effective to separate the particle sizes in the suspension, with the finer particles being propelled the greatest distance toward the sides of the working zone, and the heavier, coarser particles and dirt remaining substantially in the central region. This distribution complements, and effectively compensates for, the above-mentioned opposite distribution of particle sizes caused by prior-art schemes involving diffusion-type filtration of the fine particles through the sieves.

As a result, any fine particles lost through the sieve walls by normal diffusion are compensated by the fresh particles hurled into that area by the rollers, while the excess of fine particles in the center is accompanied, in the instant scheme, by a concentration of coarse particles. The resulting controlled distribution of particles across the working zone (i.e., throughout the cross-section of the finished sheet) thereby avoids one of the main limitations of the prior art.

The resulting final product emerging from the bottom of the working zone therefore exhibits a high degree of volumetric stability, attractive appearance and high physical and mechanical strength.

If desired, a multi-layer sheet may be produced by the instant arrangement with the use of suitable coating facilities associated with the advancing sieves upstream of the working zone. In particular, a relatively wet or dry outer layer may be initially deposited on the inner surface of the sieves. As such layers advance into the working zone, their inner surfaces are bombarded by the fibrous suspension propelled outwardly by the spraying rollers. The high kinetic energy of the impact of the particles hitting the surfaces of the pre-coated outer layers assures efficient and intimate interengagement of the particles forming the interface of the now-formed inner layer and the outer layers, thereby improving the mechanical strength of the resulting laminated sheet and also increasing its resistance to peeling.

If desired, additional flexibility in controlling the distribution of particles in the fibrous layer formed in accordance with the invention is accomplished by providing for the reversal of the relative direction of rotation of the rollers. Such expedient is effective to reverse the distribution of particle sizes in the fibrous layer, with the coarser particles being concentrated at the surface and the finer particles being concentrated in the middle; such arrangement may be useful, e.g., when increased resistance to bending is desired.

Efficient separation of the intercepted fibrous liquid from the vanes, together with a degree of control of the size of the spraying zone, is facilitated by disposing a pressurized medium reservoir in the interior of each of the spraying rollers, and providing radial passages between such reservoir and the circumference of the rollers intermediate the radial vanes. Air pressure blown from the reservoir through the radial passages have been found to more efficiently effect separation of the particles to be propelled from the vanes.

Because of the kinetic energy of the particles hitting the walls of the converging sieves, it has not been found necessary to apply conventional suction-type drying facilities for use with the upper part of the working zone. Such suction facilities, if needed at all for this purpose, may be restricted to the lower portion of the working zone.

The nozzle arrangement for introducing fibrous suspensions into the working zone may take the form of a single, centrally disposed orifice. Alternatively, a pair of transversely spaced nozzles, disposed symmetrically on opposite sides of the longitudinal axis, may be arranged above the individual spraying rollers so that each roller intercepts only the liquid from the associated nozzle. This is particularly advantageous when a reinforcing sheet is to be inserted in the center of the finished product, since such sheet can be advanced along the longitudinal axis intermediate the nozzles.

Of particular use when multi-layer structures are to be formed without the use of pre-formed outer layers is an arrangement of three adjacently successive nozzles distributed symmetrically about the longitudinal axis. With this arrangement, the suspension associated with the outer nozzles, after propulsion by the associated rollers, eventually form the outer layers of the finished product, while the suspension carried by the inner nozzle forms the inner layer of the product.

BRIEF DESCRIPTION OF THE DRAWING

The invention is further set forth in the following detailed description taken in conjunction with the appended drawing, in which.

DETAILED DESCRIPTION

Figure 1:
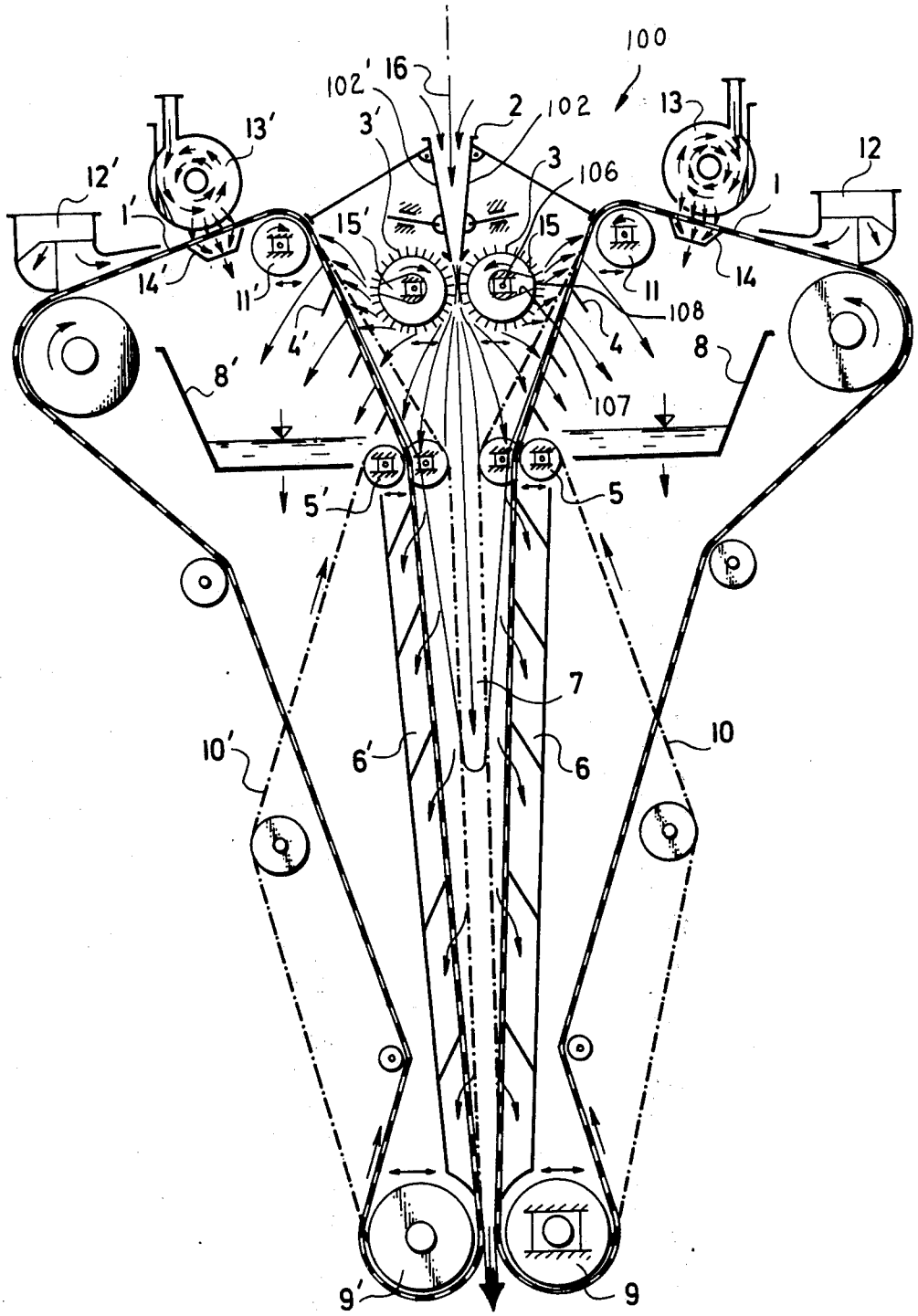
FIG. 1 is an elevation view, in schematic form, of a first embodiment of fibrous-sheet manufacturing apparatus constructed in accordance with the invention, with certain facilities for changing the direction and speed of the various rollers therein being omitted for purposes of clarity.

Referring now to FIG. 1, a first arrangement 100 for producing single or multi-layer sheets of fibrous material is depicted. A pair of endless sieves, 1, 1' are continuously advanced over a plurality of rollers including, for example, an upper roller pair 11, 11', an intermediate set of guide rollers 5, 5' and a lower set of rollers 9, 9'.

Between the respective roller pairs 5, 11 and 5', 11', respectively, the advancing sieves 1, 1' exhibit a first downwardly converging region which bounds the upper portion of a wedge-shaped working zone 7. Such converging portions are symmetrically disposed with respect to a longitudinal axis 16 of the apparatus 100. Furthermore, the region of the advancing sieves between corresponding pairs of the rollers 5, 9 and 5', 9', respectively, define the lower portion of the working zone 7, whose degree of convergence to the longitudinal axis is more gradual than the upper portion of the zone 7.

Disposed within the upper portion of the zone 7 are a pair of transversely spaced spraying rollers, 15, 15', which are rotated in mutually opposite directions by suitable facilities not depicted in FIG. 1, and at an adjustable speed. The sense of the opposite rotations of the rollers 15, 15' is chosen, in the arrangement of FIG. 1, such that the component of motion of both rollers along the axis 16 are downwardly directed. The rollers 15, 15', which are disposed symmetrical to the axis 16, are provided with a plurality of radial vanes 3, 3' which are circumferentially spaced on their respective peripheries. As shown, the vanes 3, 3' are rotatable into intercepting relation with a fibrous suspension which is introduced into the upper part of the working zone 7 by means of a single nozzle 2, which extends downwardly into the working zone along the axis 16.

The vanes 3, 3' are effective, during the rotation of the associated rollers 15, 15', to propel the fibrous suspension intercepted thereby outwardly and downwardly toward the bounding sieves 1, 1' and toward the bottom of the working zone 7 in symmetrical relation to the longitudinal axis 16, as indicated by the arrows. The speed of propulsion of the intercepted suspension is a function of the rotational speed of the rollers 15, 15', which is made adjustable by suitable facilities not shown in FIG. 1. The size of the spraying zone, in turn, may be adjusted by a combination of the speed of the rollers 15, 15', the transverse separation of the rollers 15, 15', and the angularity of the sieve walls in the upper and lower portions of the zone 7. Such angularity, or degree of convergence, is controllable by adjusting the transverse spacing of one or more of the roller pairs 11, 11', 5, 5', and 9, 9', as shown.

The rotating vanes 3, 3' are also effective to separate the propelled liquid suspension into a particle size distribution which ranges from relatively fine, at the boundaries of the working zone 7, to relatively coarse in the region around the axis 16. This action occurs, in the arrangement of FIG. 1, because the finer and lighter particles are propelled for a larger distance by the vanes 3, 3' than are the heavier, coarser particles and dirt in the introduced suspension. Consequently, the relatively large concentration of fine particles around the edges of the working zone 7 tend to compensate for the otherwise rapid diffusion of such fine particles through the sieve walls 1, 1', and serve to preserve the homogeneity of the resultant product. At the same time, the tendency of the fine particle distribution to be heaviest at the center in prior-art techniques is neutralized by the concentration of relatively coarse particles at the center via the action of the vanes 3, 3'. Accordingly, the resultant particle distribution across the working zone 7 is far more homogeneous and controlled than that heretofore achieved.

The high kinetic energy of the particles propelled against the walls of the sieves 1, 1' also make it unnecessary to associate, in the upper portion of the working zone 1, conventional suction-type drying facilities which forcefully draw liquid through the walls of the sieve to dry the formed layer. Instead, it is sufficient, in the arrangement of FIG. 1, merely to provide a system of directing vanes 4, 4' to help drain the emerging, relatively high velocity liquid into a system of storage tanks 8, 8'.

As the drying liquid suspension proceeds downwardly in the working zone via the advancing of the sieves 1, 1', the drying operation continues with the aid of conventional suction facilities 6, 6' disposed as shown between the associated pairs of rollers 5, 9 and 5', 9'. The solidifying, converging portions of the sheet are finally brought together in the bottom of the working zone 7, and the final sheet is advanced out of the apparatus 100 in a downwardly direction between the rolls 9, 9', as shown.

The rate of flow of the fibrous suspension from the nozzle 2 into the region between the rollers 15, 15' may be adjusted by providing for variation of walls 102, 102' in the vertical plane as shown. Also, as an aid in compressing the converging portions of the layers formed on the sieves 1, 1' by the suspensions propelled thereon by the rollers 15, 15', an auxiliary system of endless belts 10, 10' may be associated with the advancing sieves 1, 1' in the lower portion of the working zone 7.

The arrangement 100 can be adapted for the manufacture of multi-layer fibrous sheets by pre-forming on the sieves 1, 1' a pair of outer layers upstream of the working zone 7. Such pre-formed outer layers are thereafter subjected, in the working zone, to bombardment by the fibrous suspension propelled outwardly and downwardly by the rollers 15, 15' to define the inner layer of the structure, with the particles entering the interface between the inner and outer layers with sufficient kinetic energy to form a firm and efficient bond therebetween. Thus, the resulting structure exhibits increased resistance to peeling.

The pre-formed outer layers (not shown) may be formed in a relatively wet state by deposition via suitable tanks 12, 12', or may be formed in a dry state with the use of a pair of dispergators 13, 13', and an associated pair of suction-type dryers 14, 14'. The use of relatively dry layers is particularly advantageous in that in the working zone 7, the liquid in the propelled suspension is partly used to saturate the dried outer layers, leading both to an increased interengagement of the particles of the inner and outer layers and to an auxiliary arresting of the excess drainage of fine particles through the sieves 1 and 1'.

Figure 2:
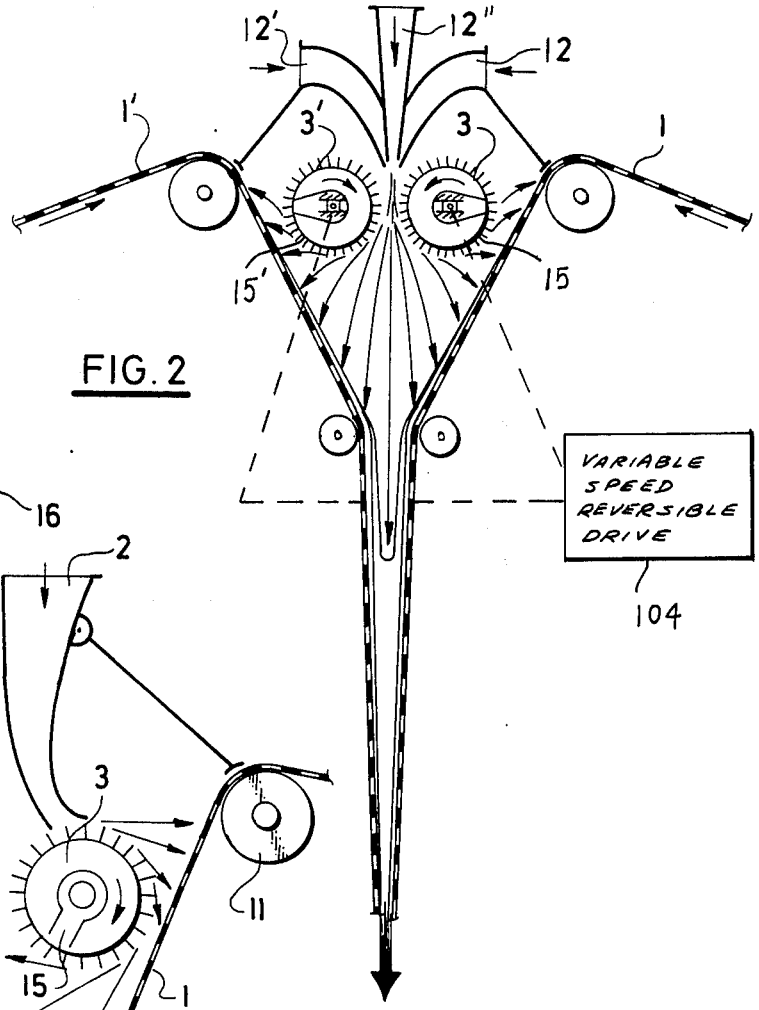
FIG. 2 is an elevation view, in schematic form, of an arrangement similar to that of FIG. 1, illustrating an alternative nozzle arrangement and illustrating certain of the variable-drive facilities omitted from FIG. 1.
Figure 3:
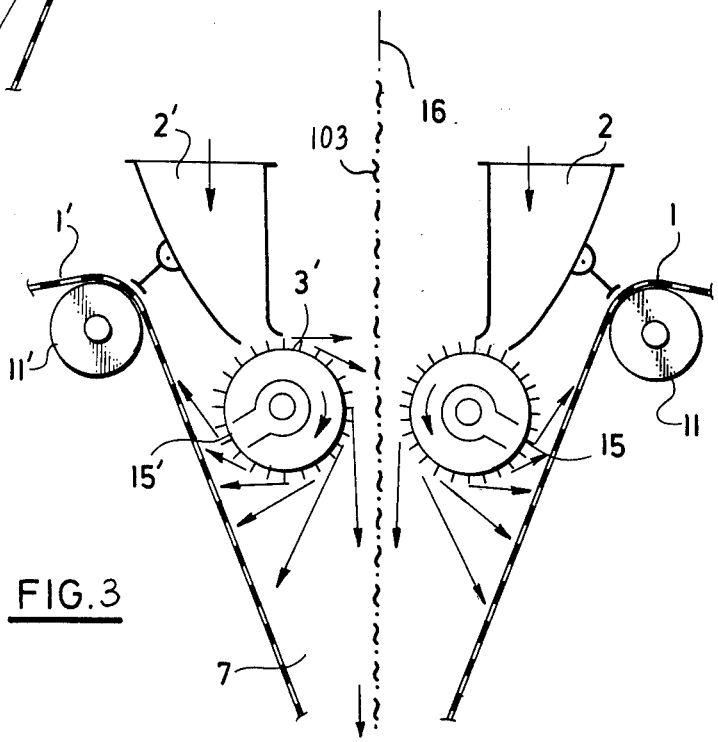
FIG. 3 is an elevation view, in schematic form, of another embodiment of the arrangement of FIG. 1, showing yet another arrangement of nozzles and the manner in which a reinforcing sheet is introduced into the center of the resulting structure.

The manufacture of multi-layer structures may be accomplished without the use of pre-formed layers, by employing either of the auxiliary schemes shown in FIG. 2 and FIG. 3. In FIG. 2, for example, separate liquid suspensions to form the inner and outer layers of the multi-layer product are introduced into three separate but converging nozzles, i.e., a pair of outer nozzles 12, 12' and a central nozzle 12''. The streams of suspension leaving the lower portions of the three nozzles extend in substantially parallel and symmetrical fashion into the space between the rollers 15, 15'. The parallel streams are intercepted and acted on by the rotating vanes 3, 3' in such a manner that the streams from the outer nozzles 12, 12' form the respective outer layers on the individual sieves 1, 1', while the central stream from the nozzle 12'' is directed downwardly to form the middle layer of the resulting product.

In the arrangement of FIG. 3, a pair of longitudinally spaced ones of the nozzles 2, 2' are disposed on symmetrically opposite sides of the longitudinal axis 16. The central space of the working zone 7 is penetrated by a particle-permeable reinforcing sheet 103, which is advanced by suitable means not shown along the longitudinal axis 16. In this case, separate types of fibrous suspensions can be introduced into the separate nozzles 2, 2', whose lower ends extend downwardly and inwardly as shown to direct the associated streams onto the vanes of individual ones of the rollers 15, 15', respectively. Such oblique incidence of the streams, together with the illustrated sense of rotation of the rollers 15, 15', (i.e., the same as in FIGS. 1 and 2) is effective to propel the particles of the individual suspensions toward the boundaries of the working zone in a distribution substantially corresponding to that of FIGS. 1 and 2, i.e., with the finer particles concentrated in the outer regions of the working zone and the coarser particles concentrated in the inner regions. Moreover, the propelled coarser particles in the central region penetrate the apertures in the reinforcing sheet 103 from both directions to form a secure bond of the sheet 103 with the remainder of the formed product.

Figure 4:
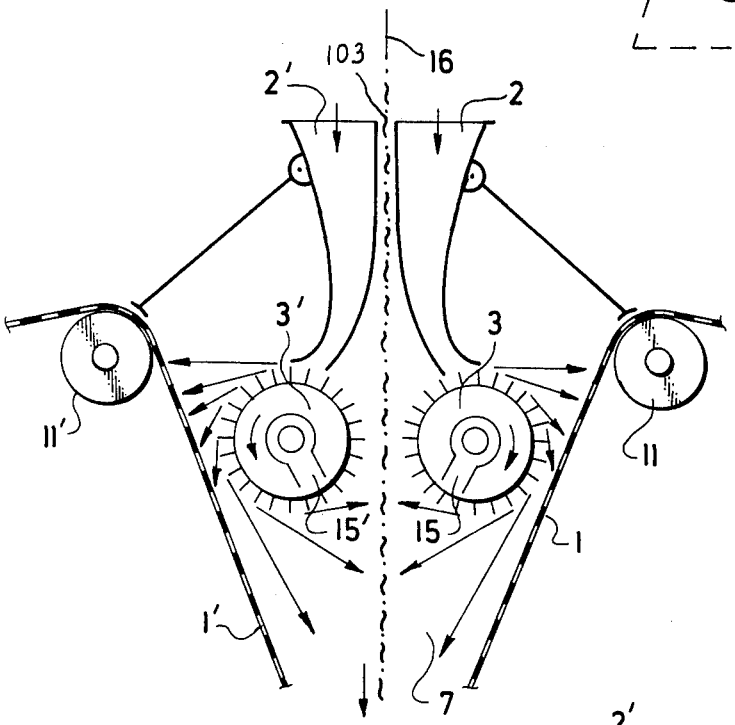
FIG. 4 is an elevation view in schematic form of an arrangement similar to FIG. 3 but having a complementary arrangement of nozzles for effecting an opposite distribution of particles to that obtained from the arrangement of FIG. 3.

The arrangement of FIG. 4 is similar to that of FIG. 3, except that the rollers 15, 15' are rotated in opposite senses to that shown in FIG. 3, while the lower ends of the nozzles 2, 2' extend downwardly and outwardly, rather than downwardly and inwardly as in FIG. 3. In FIG. 4, the combination of the outwardly oblique incidence of the streams from the nozzles 2, 2' onto the rollers 15, 15' and the reversed sense of rotation of such rollers causes the distribution of particle size in the arrangement of FIG. 4 to be opposite that produced by FIG. 3, i.e., with the relatively coarser particles appearing in the outer regions of the working zone 7 and the relatively finer particles in the central region. Such distribution in the final product is useful for certain purposes, i.e., for increased bending strength. The manner of reinforcement of such products with a central sheet 103 is accomplished in a virtually identical manner in FIGS. 3 and 4.

Any suitable facilities may be associated with the various roller sets for facilitating an adjustable transverse spacing therebetween. For simplicity, such adjustment is merely shown by the use of double-headed arrows adjacent the corresponding rollers. Additionally, the required variation of speed and sense of rotation of the oppositely-rotating rollers 15, 15' may be accomplished by any suitable apparatus familiar to those skilled in the art, which is merely designated a "variable speed reversible drive" 104 in FIG. 2.

If desired, suitable additional facilities may be associated with each of the rollers 15, 15' to increase the efficiency of separation of the intercepted particles from the vanes 3, 3' during the interception and propulsion operations. For example, a suitable pressure medium reservoir 106 (FIG. 1) may be disposed in the interior of each respective roller for receiving a suitable pressurizing fluid from a source (not shown), and for directing such pressurized fluid outwardly via passages 107 to associated apertures 108 on the periphery of the roller intermediate the associated vanes 3, 3'. Such pressurizing facilities also have an effect on the width of the spraying zone on the surface of the sieves 1, 1'.

In the foregoing, some illustrative embodiments of the inventive technique have been described. Many variations and modifications will now occur to those skilled in the art. It is accordingly desired that the scope of the appended claims not be limited to the specific disclosure herein contained.

What is claimed is:

1. In a method of forming a sheet of fibrous material, comprising the steps of advancing a pair of sieves in a downwardly converging manner symmetrical to a longitudinal axis to bound a wedge-shaped working zone between respective inner surfaces thereof, and introducing a fibrous suspension having a liquid phase into the working zone to be formed into a sheet and simultaneously dried via the passage of the liquid phase through the sieves, the improvement wherein the introducing step comprises directing the suspension into a central area of the working zone, and wherein the method further comprises the steps of supporting, in the upper portion of the working zone, a pair of transversely spaced spraying rollers symmetrical to the longitudinal axis and in intercepting relation to the suspension directed into the central area, each roller having a plurality of vanes extending outwardly from the periphery thereof, and rotating the rollers in mutually opposite directions to propel the intercepted suspension in directions symmetrical to the longitudinal axis toward the converging surfaces of the working zone, whereby a uniform, controllable fiber distribution is obtained.

2. A method as defined in claim 1, further comprising the step of forming a pair of outer layers on the inner surfaces of each of the converging sieves upstream of the working zone, whereby the rotating step forces the suspension toward and into the surfaces of the formed layers.

3. A method as defined in claim 2, in which each outer layer is in a wet state prior to the rotating step.

4. A method as defined in claim 2, in which each outer layer is in a dry state prior to the rotating step.

5. A method as defined in claim 1, in which the directing step comprises flowing first and second streams of suspension downwardly into the central area of the working zone in symmetrical relation to the longitudinal axis.

6. A method as defined in claim 5, further comprising the step of advancing a reinforcing sheet downwardly into the working zone along the longitudinal axis between the first and second streams.

7. A method as defined in claim 5, in which the directing step orients the streams into converging relation with the longitudinal axis, and in which the sense of opposite rotation of the rollers is effective to produce downward components of motion of both rollers along the longitudinal axis.

8. A method as defined in claim 5, in which the directing step orients the streams into diverging relation to the longitudinal axis, and in which the sense of opposite rotation of the rollers is effective to produce upward components of motion of both rollers along the longitudinal axis.

9. A method as defined in claim 1, in which the directing step comprises flowing first, second and third adjacent streams of suspension downwardly into the working zone in symmetrical relation with respect to the longitudinal axis.

10. In an apparatus for forming a sheet of fibrous material, comprising a pair of elongated sieves supported for movement in a downwardly converging manner in symmetrical relation to a longitudinal axis to define a wedge-shaped working zone between respective inner surfaces thereof, and means communicating with the upper portion of the working zone for introducing at least one fibrous suspension having a liquid phase into the working zone, the improvement which comprises a pair of transversely spaced spraying rollers supported for rotation in mutually opposite directions symmetrical to the longitudinal axis in the upper portion of the working zone, each of the rollers having a plurality of vanes extending radially outwardly from the periphery thereof for intercepting suspension downwardly introduced into the working zone by the introducing means and for propelling the intercepted suspension in directions symmetrical to the longitudinal axis toward the converging surfaces of the working zone, and means for rotating the rollers.

11. Apparatus as defined in claim 10, further comprising means for adjusting the transverse spacing of the spraying rollers.

12. Apparatus as defined in claim 10, in which the rotating means comprises means for reversing the relative directions of rotation of the spraying rollers.

13. Apparatus as defined in claim 10, in which the means for rotating comprises means for driving the respective spraying rollers at a selectable speed.

14. Apparatus as defined in claim 10, in which each spraying roller includes a pressurized fluid reservoir disposed in the interior thereof, and means individually defining passages between the reservoir and the portions of the circumference of the spraying rollers intermediate the vanes thereon.

15. Apparatus as defined in claim 10, further comprising means associated with the advancing sieves upstream of the working zone for applying a layer of material on the inner surface of each advancing sieve.

16. Apparatus as defined in claim 15, further comprising means associated with each applying means and upstream of the working zone for drying the applied layer.

17. Apparatus as defined in claim 10, in which the introducing means comprises a single nozzle extending into the working zone along the longitudinal axis.

18. Apparatus as defined in claim 10, in which the introducing means comprises first and second transversely spaced nozzles extending in parallel relation symmetrical to the longitudinal axis for individually directing separate suspensions toward individual ones of the spraying rollers.

19. Apparatus as defined in claim 18, further comprising means for advancing a reinforcing sheet into the working zone along the longitudinal axis between the first and second nozzles.

20. Apparatus as defined in claim 18, in which the first and second nozzles each have outwardly and downwardly directed lower ends.

21. Apparatus as defined in claim 18, in which the first and second nozzles each have inwardly and downwardly directed lower ends.

22. Apparatus as defined in claim 10, in which the introducing means comprises first, second and third nozzles having lower ends extending parallel and symmetrical to the longitudinal axis in successively adjacent relation.

23. Apparatus as defined in claim 10, further comprising suction means associated with the converging sieves in the lower portion of the working zone for drawing liquid from the associated sieve.

* * * * *